United States Patent [19]

Clay

[11] 4,100,782

[45] Jul. 18, 1978

[54] SHOT PEENING PROCESS

[76] Inventor: Robert A. Clay, 17392 Laurie La., Tustin, Calif. 92680

[21] Appl. No.: 737,540

[22] Filed: Nov. 1, 1976

[51] Int. Cl.[2] ..... B24C 1/00

[52] U.S. Cl. ..... 72/53; 51/319

[58] Field of Search ..... 72/53, 40; 51/5 A, 319, 51/9

[56] References Cited

U.S. PATENT DOCUMENTS

| | | | |
|---|---|---|---|
| 1,914,587 | 6/1933 | Wise | 72/40 |
| 3,031,802 | 5/1962 | Leliaert | 51/9 |
| 3,131,457 | 5/1964 | Correll | 72/53 |
| 4,004,374 | 1/1977 | Annegarn | 51/5 A |

*Primary Examiner*—C.W. Lanham
*Assistant Examiner*—Gene P. Crosby
*Attorney, Agent, or Firm*—Keith D. Beecher

[57] ABSTRACT

A shot peening process is provided for treating elongated oil well sucker rods, drill pipes and the like. In accordance with the process of the invention, the rods or pipes are passed through appropriate shot peening equipment along an arcuate path, and each rod or pipe is simultaneously rotated about its longitudinal axis. This action causes the rods or pipes to be flexed during the shot peening action. The effect of the flexing is to set the inner fibers of the rods or pipes under compression, thereby extending the fatigue resistance of the treated rods.

1 Claim, 2 Drawing Figures

SHOT PEENING PROCESS

BACKGROUND OF THE INVENTION

Shot peening is a metal-finishing operation in which small steel shot is directed against the workpiece being treated. The impact of the shot on the workpiece plastically deforms the surface thereof to a depth of a few thousandths of an inch, producing residual compressive stress. The workpiece is thus made more resistant to fatigue failure. Surface hardness of the workpiece is also increased by the cold working produced by the shot. The shot is hurled against the workpiece at high velocity by centrifugal action or by an air blast.

The two most common failures of metal are due to plastic deformation and fracture. Both these failures are caused by tensile strain. Plastic deformation is caused by the weakening of the metal under a steady load, and fracture is caused by an actual break in the crystalline structure of the metal by repeated flexing. The prior art shot peening process results in a compacting of the surface of the metal which enhances its resistance to both of the aforesaid causes of failure.

DETAILED DESCRIPTION OF THE ILLUSTRATED EMBODIMENT

Figure 1:
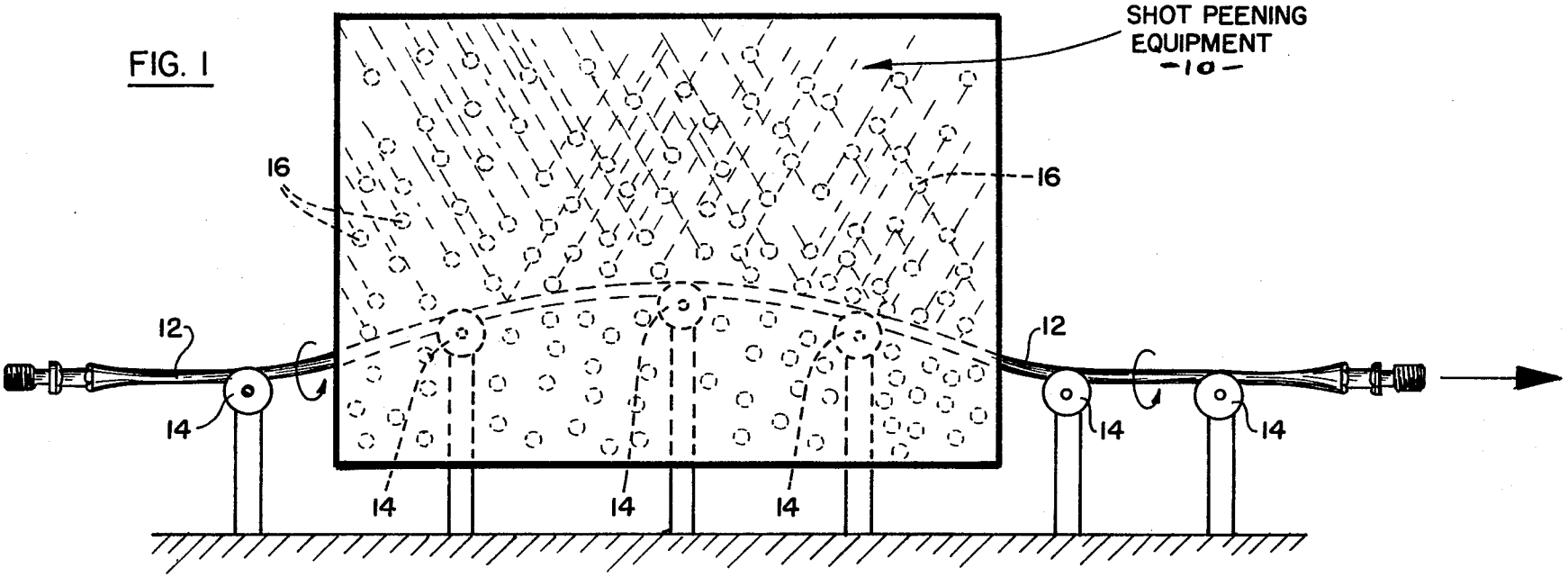
FIG. 1 is a schematic representation showing an oil well sucker rod being drawn through appropriate shot peening equipment in carrying out the process of the invention in one of its embodiments.

As shown in FIG. 1, shot peening equipment 10 is provided, in which hard round steel shot is driven against the surface of the workpiece within the equipment, in accordance with any known prior art practice.

In carrying out the process of the invention, an elongated member, such as an oil well sucker rod 12 is passed through the shot peening equipment 10 along a series of rollers 14. As shown, the rollers cause the sucker rod 12 to describe an arcuate path as it passes through the shot peening equipment 10. The sucker rod is also rotated about its longitudinal axis as it is passed through the shot peening equipment 10, and this results in a continuous flexing action at the surface of rod 12.

Figure 2:
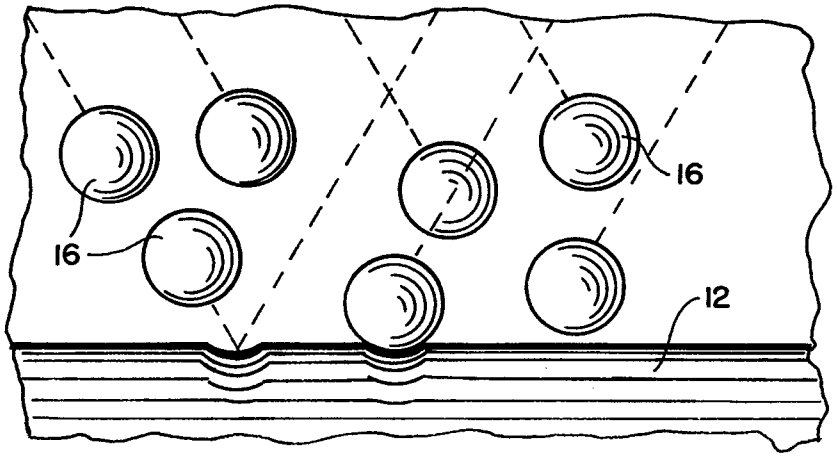
FIG. 2 is a schematic representation of the action of the shot on the surface of the rod within the shot peening equipment.

When the stream of round steel shot 16 strikes the surface of the sucker rod 14, it hammers the surface (FIG. 2) causing two reactions. First, it causes the flow of the surface fibers beyond their tensile yield point, and the resulting pitted surface exhibits enhanced tensile strength and increased endurance. Secondly, the action sets up an area of compressive stress in the surface of the rod which counteracts the tensile stresses of repeated flexing or steady load when the rod is in use.

Thus, the total effect of the prior art shot peening process is to provide a surface which is in residual compression, while the fibers immediately below the surface are in tension. The effect of the flexing of the rod in accordance with the process of the present invention is to set the inner fibers of the rod under compression. This action extends the fatigue resistance of the treated rod.

The invention provides, therefore, an improved shot peening process for the treatment of sucker rods, drill pipes, and other materials associated with the oil and other industries, whereby the rod or pipe is continuously flexed during the shot peening operation to enhance the results of the operation.

While a particular embodiment of the invention has been shown and described, modifications may be made. It is intended in the claims to cover the modifications whih come within the spirit and scope of the invention.

What is claimed is:

1. A shot peening process for the treatment of elongated members such as rods, pipes, and the like, said process comprising: passing the elongated member through shot peening equipment along an arcuate path to subject the surface of the elongated member to cold working by streams of shot directed at its surface within the equipment, and rotating the elongated member about its longitudinal axis as it is passed through the shot peening equipment to provide a continuous flexing action thereto.

* * * * *